US005273292A

United States Patent [19]

Pardi et al.

[11] Patent Number: 5,273,292

[45] Date of Patent: Dec. 28, 1993

[54] PORTABLE SOCCER GOAL

[76] Inventors: Edward M. Pardi, 93 Ridge Rd., Madison, Conn. 06443; James H. Gravel, 16 Anson Hunter La., South Orleans, Mass. 02662

[21] Appl. No.: 955,299

[22] Filed: Oct. 1, 1992

[51] Int. Cl.[5] ..... A63B 63/00

[52] U.S. Cl. ..... 273/400

[58] Field of Search ..... 273/398, 400, 401, 402, 273/411, 181 F

[56] References Cited

U.S. PATENT DOCUMENTS 4,116,446 9/1978 Thompson ..... 273/181 F 4,127,272 11/1978 Pennell ..... 273/398

4,210,326 7/1980 Booth et al. ..... 273/402 X 5,080,375 1/1992 Moosavi ..... 273/400

5,186,469 2/1993 Terris ..... 273/400

*Primary Examiner*—William H. Gries

*Attorney, Agent, or Firm*—Kane, Dalsimer, Sullivan, Kurucz, Levy, Eisele and Richard

[57] ABSTRACT

A portable soccer goal assembly is described, which is readily erected and taken down. The goal assembly is stable against tipping or buckling even when several individuals climb upon the vertical supports and cross-bar, as occurs frequently when the goal assembly is accessible at opportune moments.

16 Claims, 5 Drawing Sheets

PORTABLE SOCCER GOAL

BACKGROUND OF THE INVENTION

1. Field of Invention

The invention relates to sporting equipment and more particularly to a soccer goal which may be erected, taken down and moved with ease.

2. Brief Description of Related Art

The game of soccer has its roots in early Greek and Roman civilizations. The British have been given credit (or blame) for the game as generally played today. It has been said that the game actually developed from warfare between opposing forces.

In any event, few games arouse spectators to carry out war-like behavior as surely as will soccer. Even in recent years, soccer spectators have overrun the playing fields, wreaking havoc on fellow spectators, players and equipment such as the goal assemblies. Even when the game is long over, people with access to the goal assemblies often are aroused to climb the assemblies (for whatever reason). In recent years, several deaths have been attributed to such behavior, when the goal assembly fell forward from the weight of climbers.

Soccer goal assemblies have been fabricated in a number of configurations. The regulation mandated size is about 24 feet between vertical support posts and a cross-bar at a height of 8 feet. One common design is to fix the vertical support posts in the ground. The upper ends of the support posts and the cross-bar are restrained from movement by backstays. To avoid collapse when climbers add their weight to the cross-bar, the vertical support posts require relatively strong, buckle-resistant materials. The Euler formula for the buckling load of such a design is:

$$P = 4\pi^2 \frac{EI}{L^2}$$

wherein

P=load at which the column will buckle

E=Young's modulus of the column material

I=second moment of area of the cross-section of the column

L=length of the column

All in mutually consistent units. However, this relatively sturdy design is not portable and the goal remains on-site as an invitation to trespassers who are subject to injury.

In the situation where a goal is portable, for example as described in U.S. Pat. No. 4,116,446, only one-fourth of the force required to buckle the fixed goal is required to tip the goal over; according to the Euler formula:

$$P = \pi^2 \frac{EI}{L^2}$$

Accordingly, there is a need for a portable goal, free of fixation to the ground, which will resist collapse or tipping over even if several individuals climb upon it.

The present invention is of a portable, buckle resistant, stabilized soccer goal.

SUMMARY OF THE INVENTION

The invention comprises a regulation sized, stabilized, portable soccer goal assembly, which comprises;

a frame defining the goal opening and having an inverted "U" shape, the free end of the legs of the "U" being adapted to stand freely on a ground surface;

outrigger means secured to the free ends of the legs of the "U", said outrigger being of a weight and length to counterbalance the weight of the frame multiplied by a factor of at least 2, preferably not more than about 10.

DETAILED DESCRIPTION OF THE PREFERRED EMBODIMENTS OF THE INVENTION

Those skilled in the art will gain an appreciation of the invention from the following description of preferred embodiments, when read in conjunction with a viewing of the accompanying drawings of FIGS. 1–8, inclusive.

Figure 1:
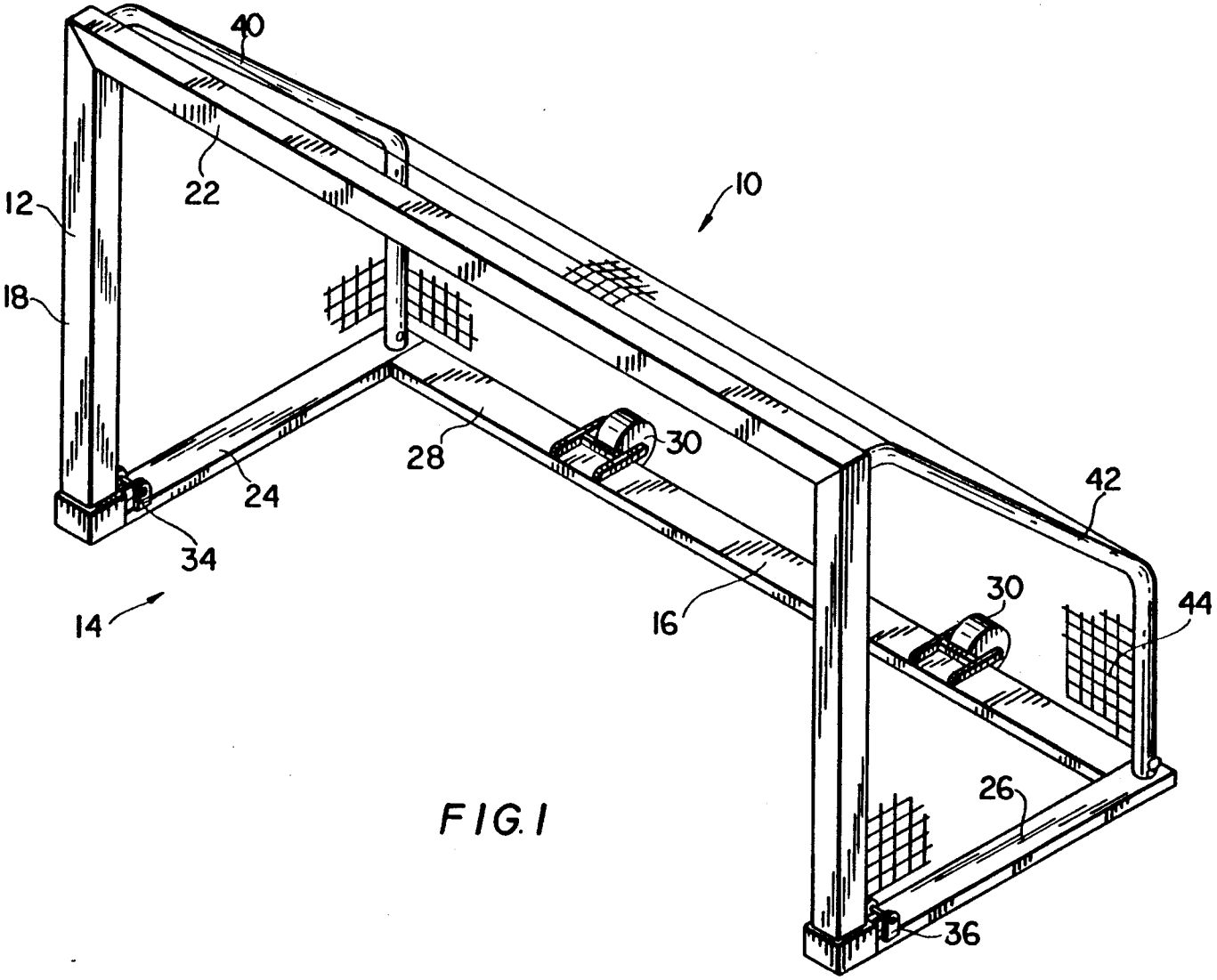
FIG. 1 is a view-in-perspective of a preferred embodiment goal assembly of the invention, shown fully erected.

FIG. 1 is a view-in-perspective of a preferred embodiment goal assembly 10 of the invention, shown fully erected. The assembly 10 is a regulation sized, stable, portable soccer goal assembly comprising a frame 12 having an inverted "U" shape, the free ends of the legs being adapted to stand freely on a ground surface. The frame 12 defines the goal opening or mouth 14 for receiving a soccer ball during play. Embodiment outrigger 16 means is secured to the free ends of the inverted "U" of frame 12. In the embodiment of FIG. 1, outrigger 16 is also in the shape of an inverted "U", the legs of which are joined to the free ends of the legs of frame 12. Outrigger 16 is constructed and designed to lie on a ground surface, and to stabilize frame 12 in an upright, vertical position. The legs of outrigger 16 together with the joining cross-member 28 are of a length and weight to counter balance the weight of frame 12, and any additional weight which might be interposed on frame 12 by several individuals climbing thereon. Advantageously, the weight of outrigger 16 equals the weight of frame 12 multiplied by a factor of at least 2, up to any practical weight, generally advantageously not exceeding a factor of 10.

In the most preferred embodiments of assembly 10, frame 12 is hingedly connected to the legs of outrigger 16 so that frame 12 may be folded down upon outrigger 16 when desired. In a folded down position, the goal assembly 10 presents less of a temptation to vandalism and rowdy climbers. Preferably, means (not shown in FIG. 1) is provided whereby the folded down frame 12 can be locked in the fold down position, to prevent erection by unauthorized personnel.

In the most preferred embodiment of the goal assembly 10 of the invention, the first vertical post 18 and the second vertical post 20 of frame 12 constitute elongate members, each having first and second ends. The horizontally disposed cross-bar 22 is secured in conventional manner to the vertical posts 18,20. For example, the components may be welded or bolted together. Advantageously, the frame 12 is fabricated from tubular components having the necessary strength to function as a goal assembly. Similarly, outrigger 16 which constitutes a goal assembly base includes base members 24,26 firmly secured to cross member 28 by any conventional means such as welding or bolting. Outrigger 16 may be fabricated from any conventional materials which will provide the required weight. For example, they may be made of steel or steel alloys in dimensions appropriate for the specified weight. For convenience in portability, a plurality of rollers or wheels 30 are mounted on the outrigger 16 to facilitate its movement across a ground surface. Most advantageously, the wheels 30 may be retractable from ground contact during periods when the assembly 10 is in use and portability is not required.

As mentioned earlier, the free end of vertical post 18 is hingedly connected to the base member 24 through the agency of hinge 34. Similarly, upright post 20 is hingedly connected to base member 26 through the agency of hinge 36. Advantageously, locking means such as a lock pin (not shown in FIG. 1) can be employed to secure positive connection between the upright posts 18,20 and the base members 24,26 respectively. When locked in a vertical position as shown in FIG. 1, lateral stability to the frame 12 is provided by backstays 40,42. Of course, outrigger 16 also provides security against lateral movement by virtue of structural resistance to the movement of frame 12 in the direction of the back (inward of mouth or opening 14) of assembly 10. Lateral movement forward of the goal opening 14 is provided by both the backstays 40,42 and the weight of outrigger 16. Backstays 40,42 are secured by connections between the upper part of frame 12 and the outer or distal portion of outrigger 16. A ball retaining net 44 shown fragmented in FIG. 1, covers the goal assembly 10 except for mouth 14. The net may be any conventional ball retaining net conventionally employed in like goal assemblies and need only be draped over the goal assembly structure, connected to the cross-bar 22 by any conventional means such as hooks, tabs or the like.

Figure 2:
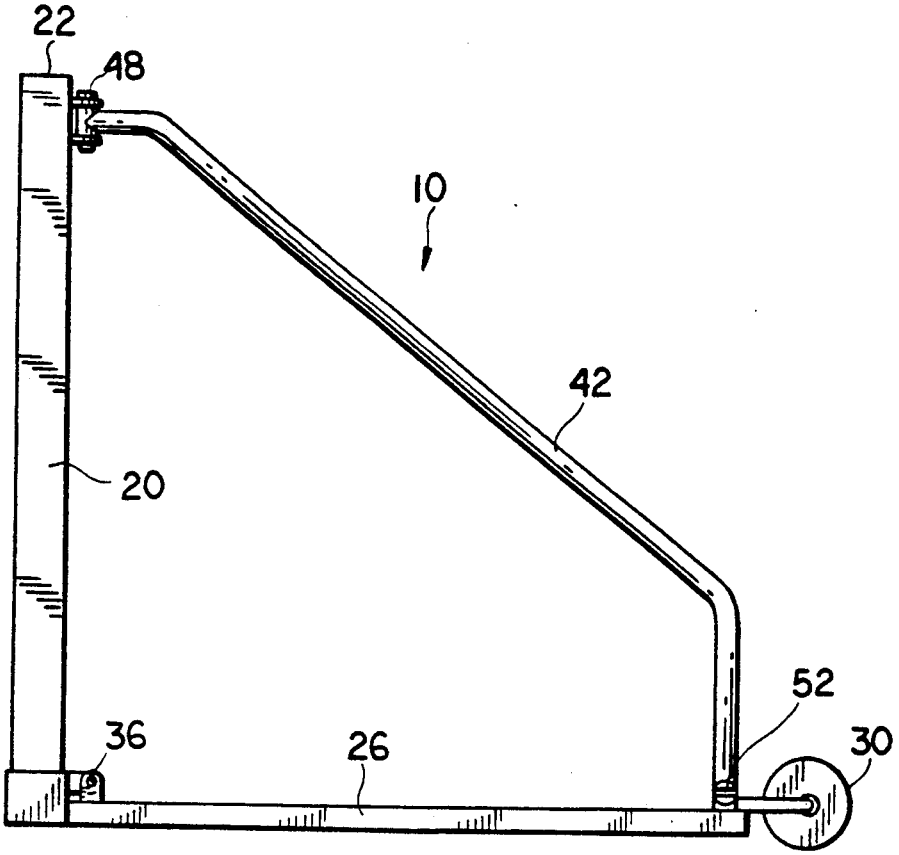
FIG. 2 is a side elevation of the embodiment assembly of the invention shown in FIG. 1.
Figure 3:
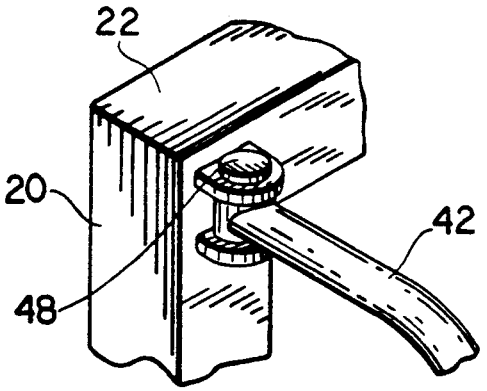
FIG. 3 is an enlarged view of the hinge connection between the frame defining the goal assembly mouth and the backstay shown in FIG. 2.

FIG. 2 is a side view of the goal assembly 10 shown in FIG. 1 and shows further detail of the construction. In a preferred construction, the backstays 40 and 42 are each hingedly connected to cross-bar 22 through the agency of a hinge connector 48. Details of this connection can be seen in FIG. 3, an enlarged view of the hinge connection between the frame 12 and the backstay 42.

Figure 4:
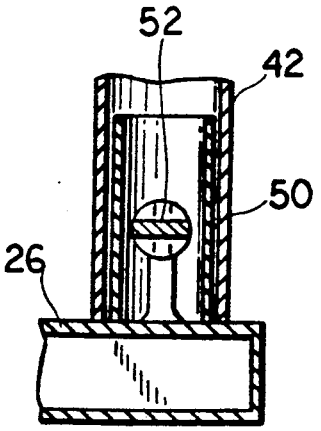
FIG. 4 is a cross-sectional, enlarged view of the connection between the outrigger component and the backstay shown in FIG. 2.

FIG. 4 is a cross-sectional, enlarged view of the connection between the outrigger 16 base member 26 and backstay 42. A similar connection exists between backstay 40 and base member 24. Sleeve 50 receives the free end of backstay 42 and is secured therein through the agency of a pin 52.

Figure 5:
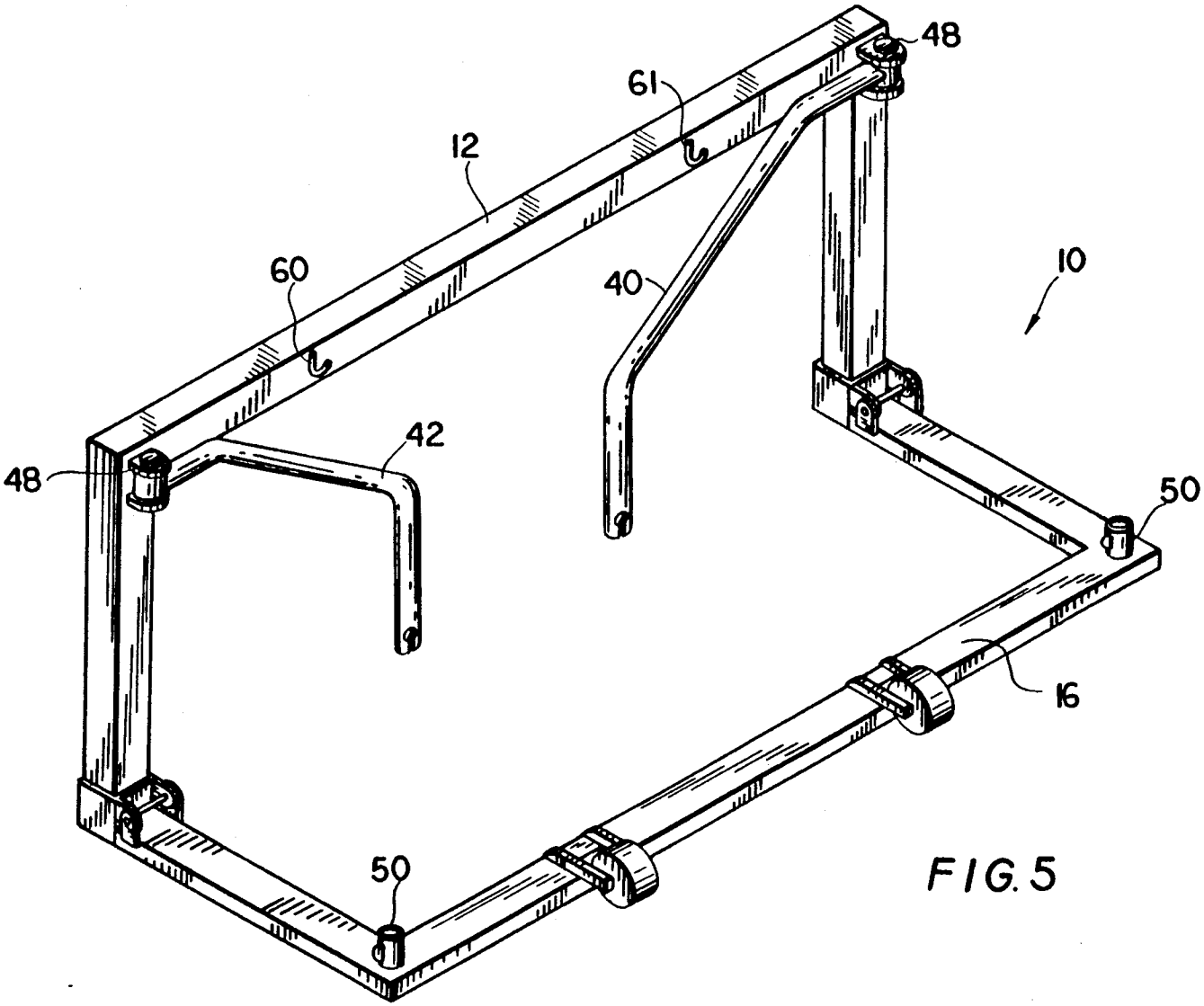
FIG. 5 is a view-in-perspective of the embodiment goal assembly of FIG. 1, shown partially taken down for portage.

FIG. 5 is a view in perspective of the embodiment goal assembly 10 of FIG. 1 shown partially taken down for portage. Thus, pin 52 has been removed freeing backstays 40,42 so that they may swing inwardly around hinges 48, thereby positioning them in the same plane as frame 12. Backstays are placed over retaining hooks 60,61 to prevent movement as backstays are folded to frame 12.

Figure 6:
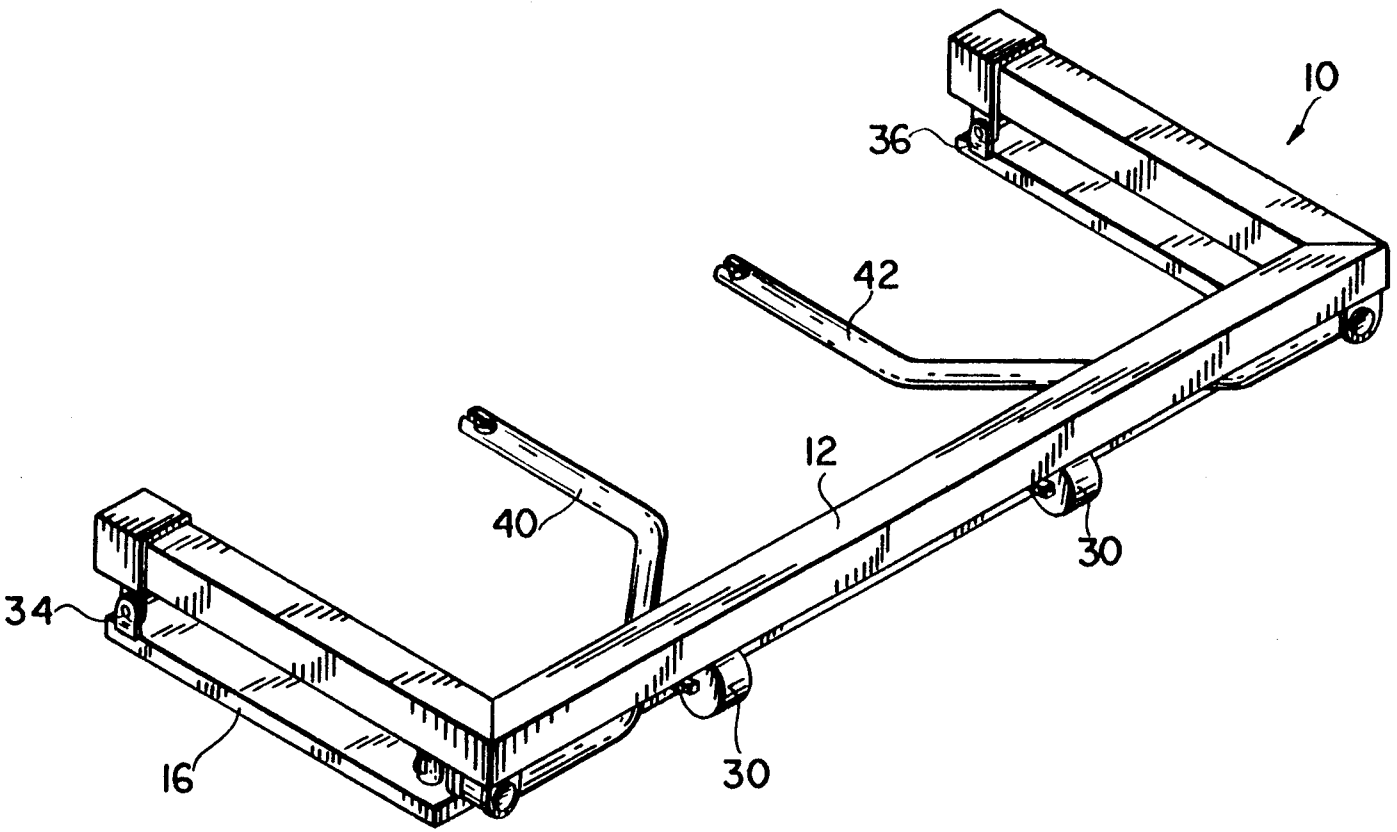
FIG. 6 is a view-in-perspective of the embodiment goal assembly of FIG. 1 fully taken down for portage.

FIG. 6 is a view in perspective of the embodiment goal assembly 10 of FIG. 1, fully taken down and in condition for portage. With backstays 40,42 folded against frame 12, frame 12 is folded downward as described previously to at least partially overlie the outrigger 16. In this position, advantageously locked down, the goal assembly 10 is in position for portable movement to a new location. When it is desired to re-erect the goal assembly 10 of the invention, the frame 12 may be raised on hinges 34,36 to an upright, erect position, advantageously locked in position and backstays 40,42 swung outwardly and secured in respective sleeves 50. Net 44 may then be re-draped in position, to provide a fully erect assembly 10 of the invention.

Figure 7:
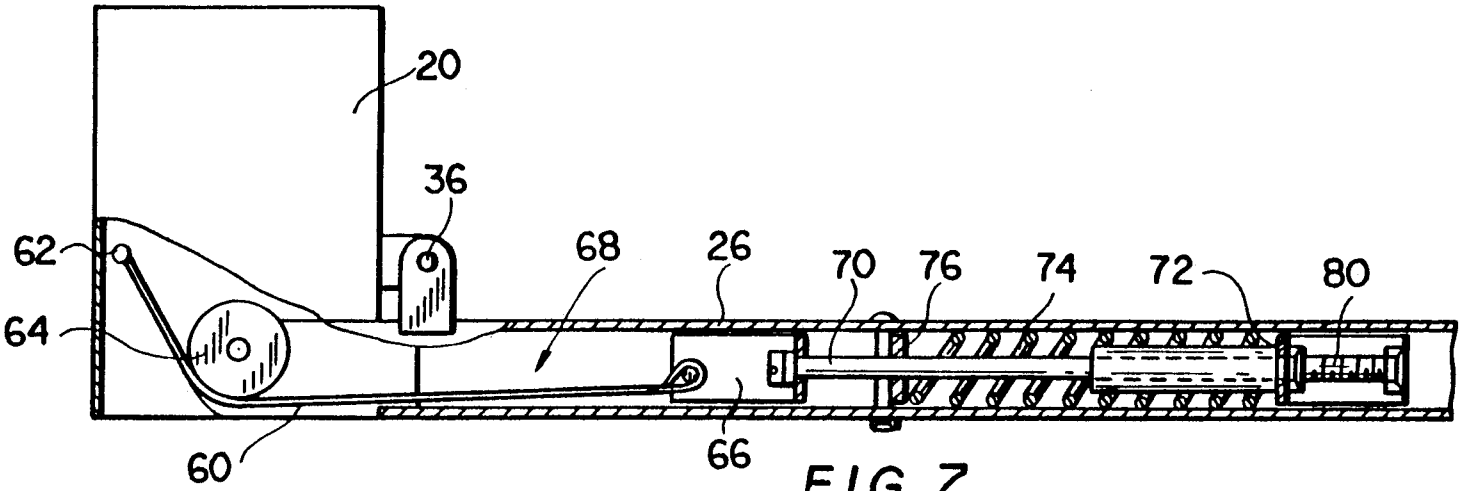
FIG. 7 is a cross-sectional view of a portion of the outrigger component of the goal assembly shown in FIG. 1, exposing a preferred means for mechanically assisting erection and take-down of the embodiment assembly of the invention.

It will be appreciated by those skilled in the art that the frame 12 is of considerable weight, in most instances, so that cross-bar 22 can be fairly rigid and well supported by the upright posts 18,20. For example, even though they may be constructed of hollow members, frame 28 can easily approximate 200 lbs. in weight. Mechanical assistance in raising and lowering frame 12 with attached backstays 40,42 is desirable. One such means is illustrated in FIG. 7, a cross-sectional side view of a portion of the outrigger 16 base member 26 component of the goal assembly shown in FIG. 1. There is exposed a preferred means for mechanically assisting erection and take down of the embodiment assembly 10 of the invention. In this case, the means comprises, as shown in FIG. 7, a strap 60 attached at point 62 to the lower, free end of upright post 20. The other end of strap 60 is threaded over pulley 64 and attached to piston 66. Piston 66 is slidably movable within chamber 68, an interior conduit of base member 26. The distal end of piston 66 is attached by rod 70 to flange 72 passing through spring 74 which can be compressed between flange 72 and flange 76. Adjusting screw 80 is accessible through an opening in the end of base member 26 for adjusting the compression of spring 74. Thus, when member 20 is folded downwardly towards outrigger 16 (towards base member 26) the weight of frame 12 functions to compress spring 74, thereby taking up energy which would be otherwise expended in free fall of frame 12 during its closure with outrigger 16. This facilitates fold down of the frame 12. With the spring 74 under compression, assistance is given to repositioning frame 12 in a vertical position, the energy of compressed spring 74 aiding in lifting frame 12. Those skilled in the art will greatly appreciate that other mechanical means may be employed to raise and lower frame 12. For example, fluid operated pistons, elastic cords and the like may be substituted for the spring activated means described above.

Figure 8:
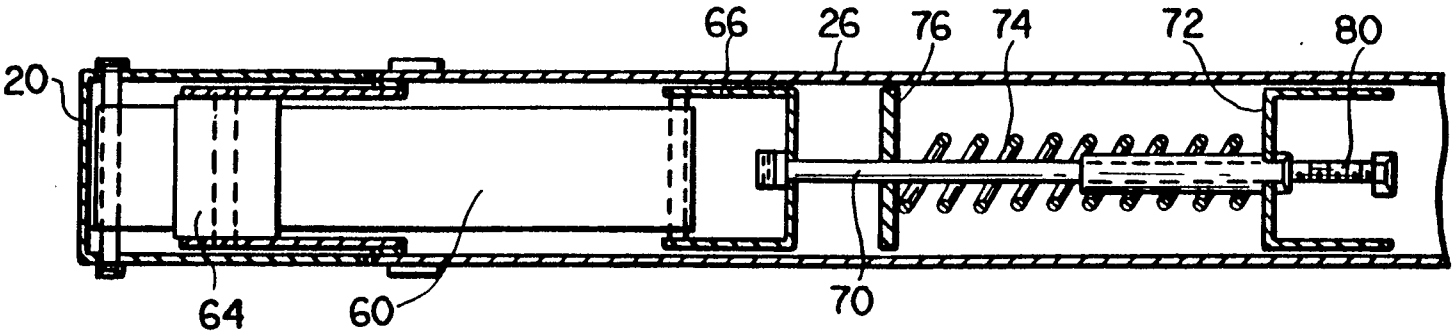
FIG. 8 is a cross-sectional, top view of the outrigger component shown in FIG. 7.

FIG. 8 is a top view of the means shown in FIG. 7, and shows further detail of this particular embodiment.

What is claimed is:

1. A regulation sized, stabilized, portable soccer goal assembly, which comprises:

a frame defining the goal opening and having an inverted "U" shape, the free end of the legs of the "U" being adapted to stand freely on a ground surface; and outrigger means secured to the free ends of the legs of the "U", said outrigger being of a weight and length to counterbalance the weight of the frame multiplied by a factor of 2 to about 10.

2. The assembly of claim 1 wherein the outrigger means comprises a pair of elongate base legs and a base cross-member joining the base legs together, said outrigger being configured in the shape of a "U" with each of the base legs secured to a free end of a frame leg.

3. The assembly of claim 2 wherein the frame is movable from a vertical position to a horizontal position overlying the outrigger.

4. The assembly of claim 3 wherein the frame is hingedly connected to the outrigger.

5. The assembly of claim 1 which further comprises means for moving the assembly over a ground surface.

6. The assembly of claim 5 wherein said means comprises a plurality of rollers attached to the outrigger.

7. The assembly of claim 1 which further comprises a backstay joining the frame to the outrigger.

8. The assembly of claim 1 wherein the frame is hingedly connected to the outrigger, whereby the frame is movable from a first position on a plane perpendicular to the plane of the outrigger, to a second position on a plane parallel to the plane of the outrigger and the assembly further comprises means to facilitate moving the frame from said first position to said second position and back to the first position.

9. A regulation sized, stabilized, portable soccer goal assembly, which comprises;

a frame defining the goal opening and having an inverted "U" shape, the free end of the legs of the "U" being adapted to stand freely on aground surface;

outrigger means secured to the free ends of the legs of the "U", said outrigger being of a weight and length to counterbalance the weight of the frame and wherein the frame is hingedly connected to the outrigger, whereby the frame is movable from a first position on a plane perpendicular to the plane of the outrigger, to a second position on a plane parallel to the plane of the outrigger and the assembly further comprises means to facilitate moving the frame from said first position to said second position and back to the first position; and said means to facilitate moving comprises spring means connecting the frame to outrigger.

10. The assembly of claim 9 wherein said spring means is located on the outrigger.

11. A stabilized, portable, soccer goal assembly, which comprises;

(A) a goal mouth frame, which comprises;

1. a first vertical post, having
   (i) a first end;
   (ii) a second end; and
   (iii) an elongate body extending between and joining together the first and second ends;
2. a second vertical post, having
   (i) a first end;
   (ii) a second end; and
   (iii) an elongate body extending between and joining together the first and second ends of the second vertical post;
3. a horizontally disposed cross-bar having
   (i) a first end;
   (ii) a second end; and
   (iii) an elongate body extending between and joining together the first and second ends of the cross-bar; said first end of the first vertical post being connected to the first end of the cross-bar and the first end of the second vertical post being connected to the second end of the cross-bar; whereby the goal mouth frame forms an inverted first "U" shape defining the mouth of the soccer goal;

(B) a goal base, which comprises;

1. a first base member having
   (i) a first end
   (ii) a second end; and
   (iii) an elongate body extending between and joining together the first and second ends;
2. a second base member having
   (i) a first end;
   (ii) a second end; and
   (iii) an elongate body extending between and joining together the first and second ends of the second vertical post;
3. a base cross-member having
   (i) a first end;
   (ii) a second end; and
   (iii) an elongate body extending between and joining together the first and second ends of the cross-member; said first end of the first base member being connected to the first end of the base cross-member, and the first end of the second base member being connected to the second end of the base cross-member; whereby the goal base forms an inverted second "U" with the open end of the second "U" being continuous with and adjacent to the open end of the first "U"; the second end of the first vertical post being hingedly connected to the second end of the first base member; the second end of the second vertical post being hingedly connected to the second end of the second base member;

whereby the goal mouth frame is hingedly movable from a first position on a plane perpendicular to the plane of the goal base, to a second position parallel to the plane of the goal base and at least partially overlying the goal base;

(C) a first backstay having 1. a first end hingedly connected to the goal mouth frame at a point proximal to the cross-bar connection to the first vertical post;
2. a second end, removably connected to the goal base at a point proximal to the base cross member connection to the first base member;

whereby the first backstay is hingedly movable towards a second backstay from a first position on a plane perpendicular to the plane of the goal base and perpendicular to the lane of the goal mouth frame, to a second position parallel to and at least partially overlying the plane of the goal mouth frame;

(D) a second backstay having 1. a first end hingedly connected to the goal mouth frame at a point proximal to the cross-bar connection to the second vertical post;
2. a second end removably connected to the goal base a point proximal to the base cross member connection to the second base member;

whereby the second backstay is hingedly movable toward the first backstay from a first position on a plane perpendicular to the plane of the goal base and perpendicular to the plane of the goal mouth frame, to a second position parallel to and at least partially overlying the plane of the goal mouth frame;

(E) a net enclosing the goal assembly, leaving the goal mouth open;

(F) means for facilitating movement of the assembly over a ground surface; and (G) means for assisting the movement of the goal mouth frame from the first position thereof to the second position thereof and back to the first position thereof.

12. The assembly of claim 11 wherein the means for facilitating movement over a ground surface comprises a plurality of rollers mounted on the goal base.

13. A stabilized, portable, soccer goal assembly, which comprises;

(A) a goal mouth frame, which comprises;

1. a first vertical post, having (i) a first end;

(ii) a second end; and (iii) an elongate body extending between and joining together the first and second ends;

2. a second vertical post, having (i) a first end;

(ii) a second end; and (iii) an elongate body extending between and joining together the first and second ends of the second vertical post;

3. a horizontally disposed cross-bar having (i) a first end;

(ii) a second end; and (iii) an elongate body extending between and joining together the first and second ends of the cross-bar; said first end of the first vertical post being connected to the first end of the cross-bar and the first end of the second vertical post being connected to the second end of the cross-bar;

whereby the goal mouth frame forms an inverted first "U" shape defining the south of the soccer goal;

(B) a goal base, which comprises;

1. a first base member having (i) a first end;

(ii) a second end; and (iii) an elongate body extending between and joining together the first and second ends;

2. a second base member having (i) a first end;

(ii) a second end; and (iii) an elongate body extending between and joining together the first and second ends of the second vertical post;

3. a base cross-member having (i) a first end;

(ii) a second end; and (iii) an elongate body extending between and joining together the first and second ends of the cross-member; said first end of the first base member being connected to the first end of the base cross-member, and the first end of the second base member being connected to the second end of the base cross-member; whereby the goal base forms an inverted second "U" with the open end of the second "U" being continuous with and adjacent to the open end of the first "U"; the second end of the first vertical post being hingedly connected to the second end of the first base member; the second end of the second vertical post being hingedly connected to the second end of the second base member;

whereby the goal mouth frame is hingedly movable from a first position on a plane perpendicular to the plane of the goal base, to a second position parallel to the plane of the goal base and at least partially overlying the goal base;

(C) a first backstay having

1. a first end hingedly connected to the goal mouth frame at a point proximal to the cross-bar connection to the first vertical post;

2. a second end, removably connected to the goal base at a point proximal to the base cross member connection to the first base member;

whereby the first backstay is hingedly movable towards a second backstay from a first position on a plane perpendicular to the plane of the goal base and perpendicular to the plane of the goal mouth frame, to a second position parallel to and at least partially overlying the plane of the goal mouth frame;

(D) a second backstay having

1. a first end hingedly connected to the goal mouth frame at a point proximal to the cross-bar connection to the second vertical post;

2. a second end removably connected to the goal base a point proximal to the base cross member connection to the second base member;

whereby the second backstay is hingedly movable toward the first backstay from a first position on a plane perpendicular to the plane of the goal base and perpendicular to the plane of the goal mouth frame, to a second position parallel to and at least partially overlying the plane of the goal mouth frame;

(E) a net enclosing the goal assembly, leaving the goal mouth open;

(F) means for facilitating movement of the assembly over a ground surface; and (G) means for assisting the movement of the goal mouth frame from the first position thereof to the second position thereof; and wherein the means for assisting movement of the goal mouth frame comprises spring means connecting the goal base to the goal mouth frame.

14. The assembly of claim 13 wherein the spring means is located in a hollow of the first and the second base members.

15. The assembly of claim 13 wherein the spring means is adjustable to vary compression force.

16. In a regulation sized, portable soccer goal assembly, which comprises;

a frame defining the goal opening and having an inverted "U" shape, the free end of the legs of the "U" being adapted to stand freely on a ground surface; and outrigger means secured to the free ends of the legs of the "U", the improvement, which comprises;

said outrigger means having a weight and length to counterbalance the weight of the frame multiplied by a factor of 2 to about 10.

* * * * *